US007007507B2

(12) United States Patent
Enevoldsen

(10) Patent No.: US 7,007,507 B2
(45) Date of Patent: Mar. 7, 2006

(54) NECKLACES AND BRACELETS WITH KEEPERS

(75) Inventor: Per A. Enevoldsen, Roederovre (DK)

(73) Assignee: Pandora Jewelry, LLC, Columbia, MD (US)

( * ) Notice: Subject to any disclaimer, the term of this patent is extended or adjusted under 35 U.S.C. 154(b) by 0 days.

(21) Appl. No.: 10/623,641

(22) Filed: Jul. 21, 2003

(65) Prior Publication Data

US 2004/0144131 A1 Jul. 29, 2004

(51) Int. Cl.
*A44C 5/00* (2006.01)

(52) U.S. Cl. ..... 63/3.1; 63/3; 63/38

(58) Field of Classification Search ..... 63/1.11, 63/1.18, 3, 3.1, 3.2, 4, 5.1, 33, 37–41
See application file for complete search history.

(56) References Cited

U.S. PATENT DOCUMENTS

| | | | | |
|---|---|---|---|---|
| 1,510,421 | A * | 9/1924 | Sherman | 63/3.1 |
| 2,521,589 | A * | 9/1950 | Livingston | 63/20 |
| 3,983,716 | A | 10/1976 | Kuhn | |
| 4,237,702 | A | 12/1980 | Caverly | |
| 4,530,221 | A | 7/1985 | Weinberg | |
| 4,551,993 | A | 11/1985 | Nagahori | |
| 4,562,704 | A | 1/1986 | Benedek et al. | |
| 4,907,322 | A | 3/1990 | Kanno | |
| 5,279,132 | A | 1/1994 | Swaim | |
| 5,398,391 | A * | 3/1995 | Yokochi | 24/616 |
| 5,440,900 | A * | 8/1995 | White | 63/38 |
| 5,588,190 | A * | 12/1996 | Sato | 24/682.1 |
| 6,357,261 | B1 * | 3/2002 | Cheng | 63/3.1 |
| 6,449,810 | B1 | 9/2002 | Kuwayama | |
| 6,557,376 | B1 | 5/2003 | Pratt | |
| 6,675,611 | B1 | 1/2004 | Hunter | |
| 6,722,036 | B1 | 4/2004 | Pratt | |
| 2002/0139141 | A1 | 10/2002 | Kuwayama | |

OTHER PUBLICATIONS

Affidavit of Molly Bragg of Internet Archive with Exhibis: Aug. 15, 2005; pp 1-4.

* cited by examiner

*Primary Examiner*—Robert J. Sandy
*Assistant Examiner*—Ruth C. Rodriguez
(74) *Attorney, Agent, or Firm*—Lathrop & Gage LC

(57) ABSTRACT

This invention is a necklace or bracelet with provisions to prevent the bunching of baubles, bangles and beads which are strung on the necklace or bracelet. Bunching is prevented by keepers which are removably attached to bands fixed at intervals on the strands of the necklaces or bracelets. Two types of keepers are disclosed, one of which has internal threads which interact with a threaded bands, and one which uses a clamshell structure to secure the keeper on a band. The keepers may have a variety of shapes for decorative effects, such as cylindrical, spherical, cubical, or pyramid-shaped.

28 Claims, 6 Drawing Sheets

NECKLACES AND BRACELETS WITH KEEPERS

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO "MICROFICHE APPENDIX"

Not Applicable.

BACKGROUND OF THE INVENTION

1. Field of the Invention

This invention pertains to necklaces and bracelets with decorative baubles, bangles, and beads.

2. Description of Related Art Including Information Disclosed Under 37 CFR 1.97 and 37 CFR 1.98

A popular type of necklace includes a flexible strand to which a number of beads are retained by being strung on the strand a lumen in the bead or a loop attached to the bead. Beads often are purely decorative and come in a variety of colors and shapes and often have embedded decorative elements such as stones. In addition, beads often have symbolic meaning to the wearer and represent descendents or important events. Necklaces having a plurality of beads often suffer from "bunching", the tendency of all of the beads to collect in a single group at the bottom of the necklace rather than remain in the desirable more even distribution about the length of the necklace. The invention of this patent application prevents bunching.

U.S. Pat. No. 3,983,716 discloses a jewelry lock in which the ends of strand have attached extensions. The extensions may be secured by a jewelry lock having the external shape of a bead. It includes two hinged hemispheric cups with notches which accommodate hitches attached to the ends of a bead chain, thereby securing the ends.

U.S. Pat. No. 4,530,221 discloses a necklace attachment for shortening the length of a string of pearls. The attachment engulfs and attaches together two pearls which are in adjacent portions of a strand of pearls. Another embodiment engulfs one pearl and may be used to attach decorative elements to the strand.

U.S. Pat. No. 4,562,704 discloses a latch for a chain having a male and female element. Removable designer elements are strung over the compressed male element and are retained by the female element and uncompressed male element. There are no provisions for preventing the movement of elements on the chain.

U.S. Pat. No. 4,907,322 discloses a pearl necklace with a stainless steel wire which is secured by a retainer having a setscrew. The pearls are separated by elastic rings.

U.S. Pat. No. 5,279,132 discloses a holding device which prevents the movement of a body adornment suspended from a chain. This avoids the tendency of the clasp to walk-around or creep from the back to the front of the wearer's body. The adornment is affixed to the wearer's skin or clothing using a double-sided adhesive, spray adhesive, or brush on adhesive.

U.S. Pat. No. 6,449,810 discloses a stopper for jewelry strands. The stopper is strung on one or two strands and secured in place by two rubber rings, one above and one below the strand or strands. The stopper is used to adjust the length of a flexible strand.

None of the discovered prior art provides the advantages of the present invention, that of decorative keepers which retain beads on a necklace in a desirable distribution and prevent bunching.

BRIEF SUMMARY OF THE INVENTION

A necklace comprising a strand having two ends and a hook component attached to each end of the strand, the hook components capable of interaction with reversible attachment of the ends together. At least one band is fixedly attached to the strand, two or more beads, each bead having a bore of diameter greater than the diameter of the band and greater than the diameter of the hook component attached to one end of the strand, thereby allowing the stringing of the beads on the strand. Finally, there is at least one keeper having an outside diameter greater than the bore of the bead, the keeper capable of interacting with the band with reversible attachment of the band and keeper, thereby restricting the movement of the beads on the strand.

The objective of this invention is to provide a necklace with beads and keepers in which the beads do not bunch.

Another objective of this invention is to provide a necklace with beads and removable keepers so the distribution of the beads on the necklace can be modified by the necklace wearer.

Another objective of this invention is to provide a necklace with beads and keepers with a threaded keeper or a hinged keeper.

Another objective of this invention is to provide a necklace with beads and keepers with keepers in decorative shapes which add to the decorative effect of the necklace.

Another objective of this invention is to provide a necklace with beads and keepers with keepers of cylindrical, spherical, cubical or pyramid shapes.

A final objective is to provide a necklace with beads and keepers which can be manufactured inexpensively and without adverse effects on the environment.

DETAILED DESCRIPTION OF THE INVENTION

In this patent application body adornments such as necklaces, bracelets, anklets, waist chains are termed "necklaces". Flexible chains, wire cables, bands, filaments, cords, strings, which are a component of the necklaces are termed "strands". Baubles, bangles, pendants, trinkets, and beads which are strung on a strand are termed "beads".

Figure 1:
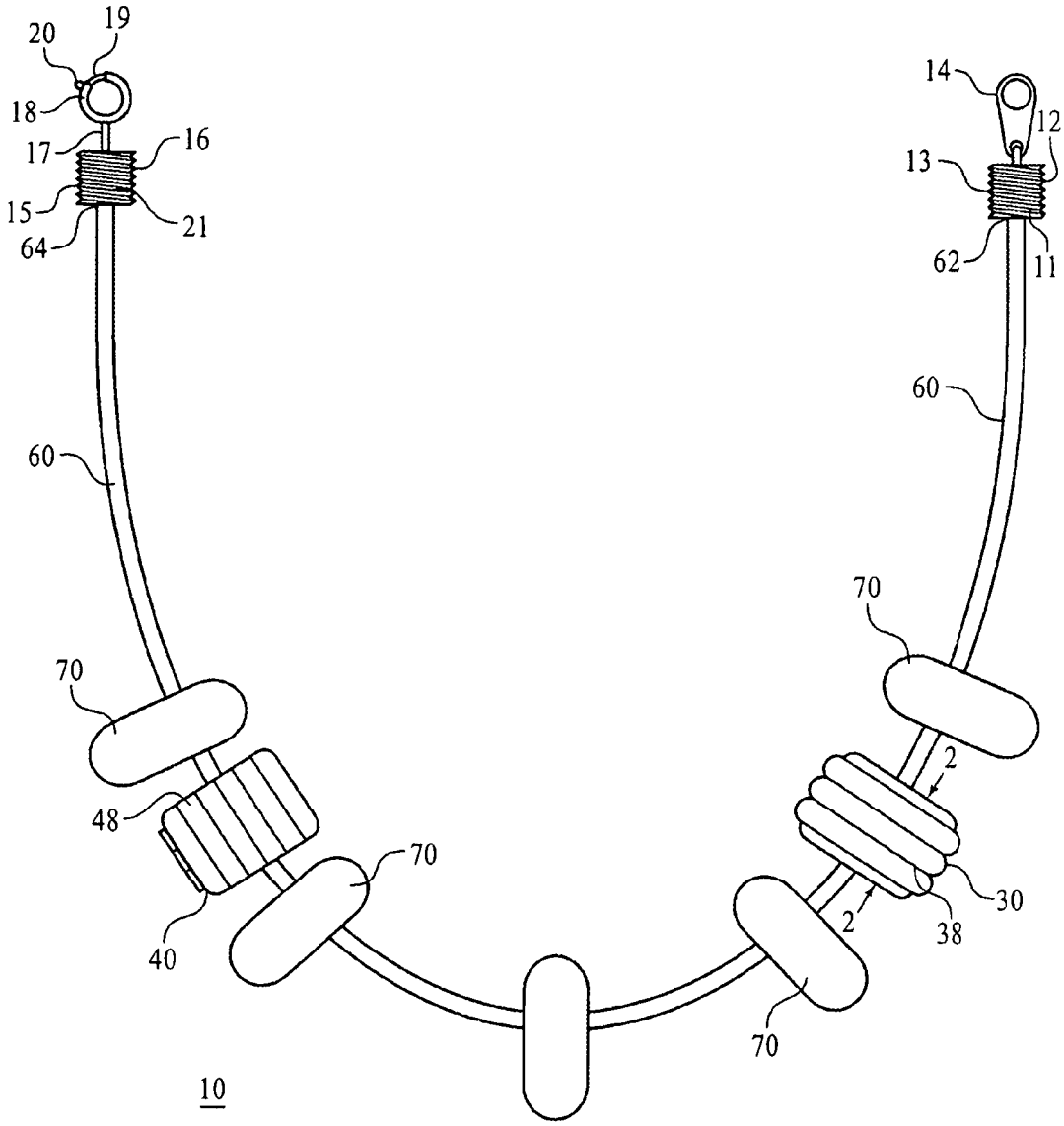
FIG. 1 is a plan view of the necklace of this invention.

FIG. 1 shows a necklace 10 of this invention. The ends of the strand 60 may be connected by the interaction of a loop connector 12 with a hook connector 15. The loop connector 12 is comprised of a cylindrical loop threaded end 13 which is fixed to a first end 62 of the strand 60. A loop connector loop 14 is connected to the loop threaded end 13. Loop connector threads 11 are cut into the surface of the loop threaded end 13. The loop connector 12 outer diameter 22 is small enough to allow passage of the threaded connector 30 bore (not visible in FIG. 1) and bead 70 bore (not visible in FIG. 1) over the loop connector 12, thereby allowing stringing of the threaded keeper 30 and bead 70 over the strand 60. The hook connector 15 is comprised of a hook threaded end 16 which is fixed to a second end 64 of the strand 60. A hook connector ring 17 is attached to the hook threaded end 16. A hook connector hook 18 is connected to the hook connector ring 17. Visible on the hook connector hook 18 is the movable hook connector latch 19 and the hook connector latch handle 20. Any suitable connectors which enable the connection of the first and second ends of the strand may be used provided that at least one connector has a diameter small enough to allow the passage over that connector of beads 70 and threaded keepers 30.

Beads 70 having a cylindrical bore (not visible in FIG. 1) are strung on the strand 60 and are free to slide back and forth on the strand. The movement of beads 70 is restrained by a threaded keeper 30 and a hinged keeper 40. The keepers are removably fixed on bands (not visible in FIG. 1) which are fixedly attached to the strand 60.

The function of the threaded keeper 30 and hinged keeper 40 is to restrain the free movement of the beads 70 on the strand 60, thereby preventing bunching and keeping the beads in a desirable distribution on the necklace.

The threaded keeper 30 has a distinctive ornamental pattern 38 on the outer surface. The hinged keeper 40 has a distinctive ornamental pattern 48 on the outer surface which is easily distinguished from the ornamental pattern 38 of the threaded keeper 30. The distinct ornamental patterns allow the necklace wearer to easily distinguish between the threaded and hinged keepers when the necklace is being assembled or in use.

The beads 70 have a cylindrical bore (not visible in FIG. 1) which is large enough to pass over the loop connector 12. Any desirable number and type of beads may be used. Any desirable number of bands can be fixed on the strand and any desired number of threaded keepers and or hinged keepers may be used with the necklace.

Figure 2:
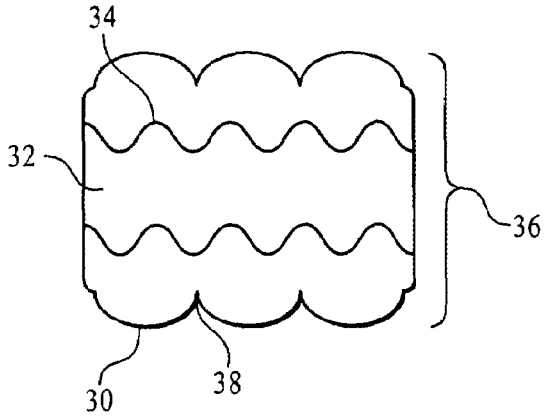
FIG. 2 is a cross-sectional view of the threaded keeper.

FIG. 2 is a cross sectional view of the threaded keeper 30 taken along line 2—2 in FIG. 1. Visible in FIG. 2 is the threaded keeper bore 32 which is of adequate size to pass over a threaded band (not visible in FIG. 2) and over at least one of the connectors, (12 and 15 in FIG. 1). The interior of the bore 32 is threaded 34 with a thread capable of interaction with and passage over the threaded keeper (not visible in FIG. 2) and the threaded portion of at least one of the connectors by rotation. Alternatively, the threaded keeper is mounted on and retained by the threaded band or threaded portion of at least one of the connectors when it is not rotated. The threaded keeper decoration 38 in the example in FIG. 2 is grooves which encompass the circumference of the cylindrical threaded connector 30. The outer dimension, in this example, the diameter of the threaded keeper 36, is larger than the bore of the beads (not shown in FIG. 2). Fixation of the threaded keeper 30 on a threaded band therefore restricts the movement of the beads on the strand and prevents bunching of the beads on the strand.

Although the threaded keeper 30 shown in FIGS. 1 and 2 is cylindrical, threaded keepers may be spherical, or have the shape of any geometric solid having three dimensions, providing the threaded bore and outer dimension has the characteristics described above.

Figure 3A:
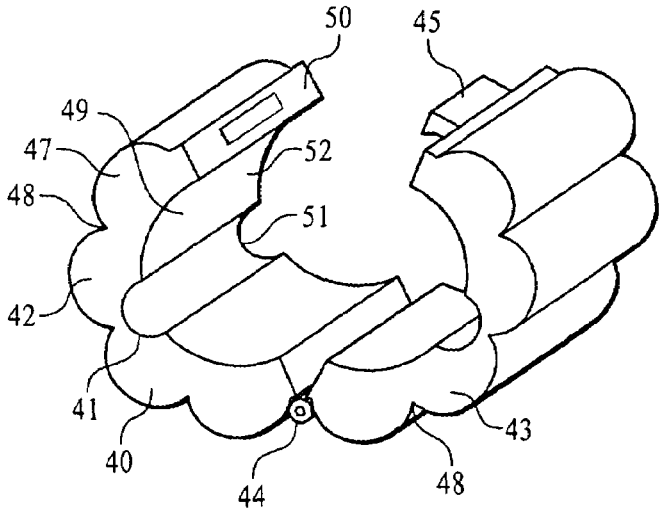
FIG. 3A is a perspective view of the hinged keeper in the open position.

FIG. 3A is a perspective view of the hinged keeper 40 in the open position. The hinged keeper 40 is comprised of a left shell 42 and a right shell 43 which are linked together by a hinge 44. The left shell 42 is comprised of a front wall 47 having a hemispheric front wall notch 41, a back wall 52 having a hemispheric back wall notch 51, a web 49 connecting the front wall 47 and back wall 52, and a top wall 50 which covers the U-shaped structure formed by the ends of the front wall 47, web 49 and back wall 52. The hemispheric front and back wall notches 41 and 51, respectively, have a diameter slightly larger than one half the diameter of the strand. The right shell 43 is a mirror image of left shell 42 except that the right shell has a friction latch 45 connected to the right shell top wall. The friction latch 45 interacts with the left shell top wall 50 when the hinged keeper 40 is in the closed position and reversibly retains the hinged keeper 40 in the closed position. The hinged keeper decoration element 48 on the outer surface of the hinged keeper is shown in FIG. 3A.

Figure 3B:
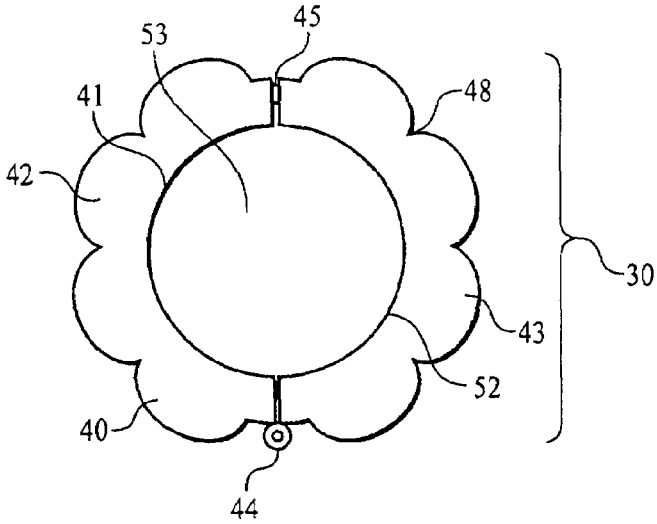
FIG. 3B is a plan view of the hinged keeper in the closed position.

FIG. 3B is a plan view of the hinged keeper 40 in the closed position. Visible in FIG. 3B is the left shell 42, hinge 44, right shell 43, and hinged keeper decoration element 48. The hinged keeper 40 is retained in the closed position by the friction latch 45. The user can open the closed hinged keeper by inserting two fingernails into the junction between the left shell and right shell at the friction latch. When the hinged keeper is in the closed position, the left shell hemispheric front wall notch 41 and the right shell hemispheric front wall notch 52 together form a hinged keeper bore 53 having a diameter which is slightly larger than the diameter of the strand but smaller than the diameter of a band (not shown in FIG. 3B). The outer dimension of the hinged keeper, in this example, the diameter of the hinged keeper when closed 46, is larger than the bore of the beads (not shown in FIG. 2). Closure of the hinged keeper 40 on a band, threaded or unthreaded, which is attached to a strand, therefore restricts the movement of beads on the strand and prevents bunching of the beads.

Although the hinged keeper 40 shown in FIGS. 1, 3A and 3B is cylindrical, hinged keepers may be spherical, or have the shape of any geometric solid having three dimensions, providing bore and outer dimension have the characteristics described above.

Figure 4:
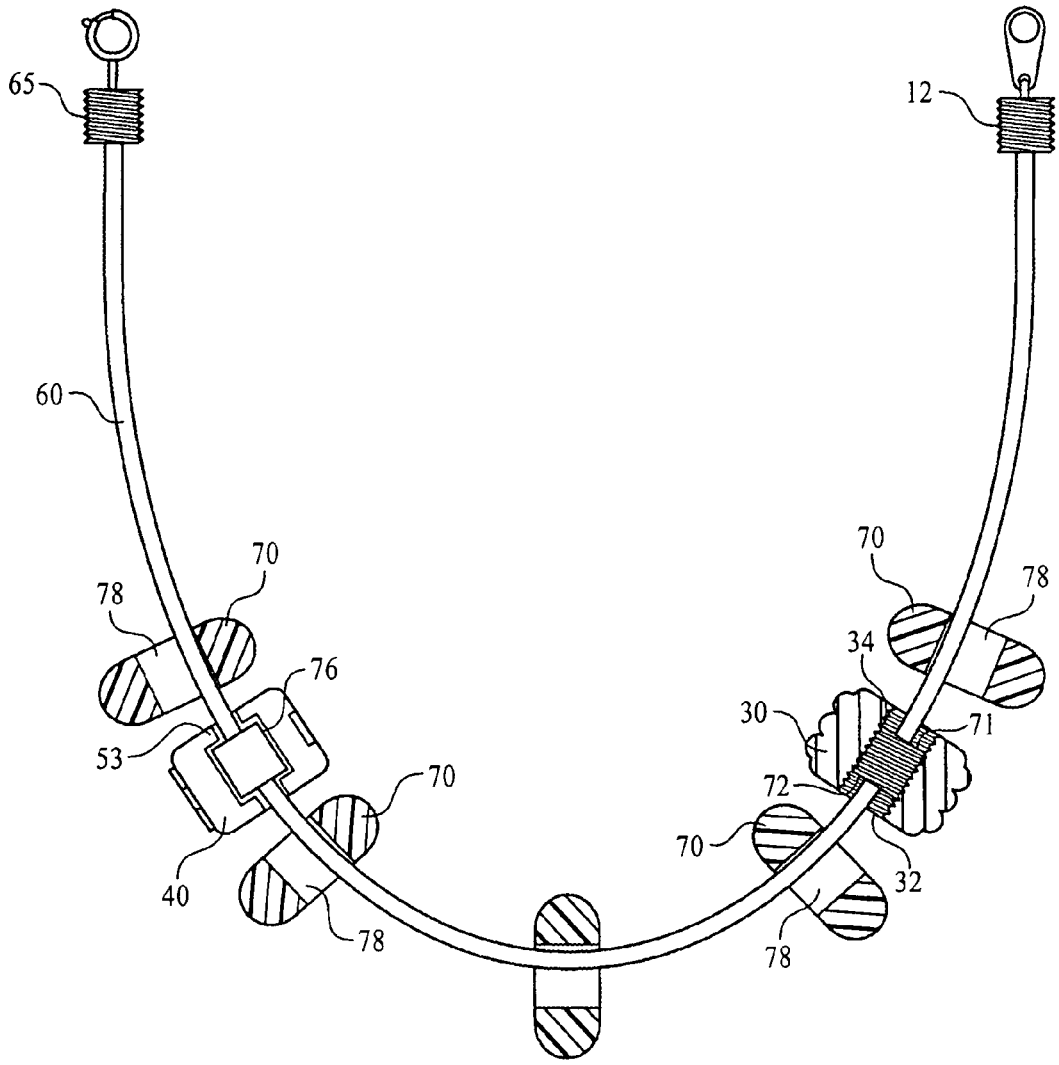
FIG. 4 is a plan view of the necklace with the keepers and beads in cross section taken along the plane of the necklace.

FIG. 4 is a plan view of the necklace with the keepers and beads in cross section taken along the plane of the necklace. Visible in FIG. 4 are the strand 60, loop connector 12, and hook connector 15. A threaded band 71 having threads 72 on the outer surface is shown fixed to the strand 60. The diameter and thread dimensions of the threaded band 70 are suitable for the threaded fixation of the threaded keeper 30 by its threads 34. The bore 32 of the threaded keeper 30 is large enough to enable the threaded keeper to be moved over the threaded band 71 by rotation of the threaded keeper 30. The bore 32 of the threaded keeper 30 is large enough to allow passage of the threaded keeper 30 over an unthreaded band 76. A hinged keeper 40 is shown in FIG. 4 in the closed position closed over an unthreaded keeper 76. The bore 53 of the hinged keeper 40 is small enough to prevent movement of the hinged keeper 40 when the hinged keeper 40 is closed over an unthreaded band 76. Also shown in FIG. 4 are beads 70 which are strung on the strand 60. The bores 78 of the beads 70 are large enough to allow movement of the beads 70 over at least one of the connectors 12 and 15, over the threaded bands 71, and over the unthreaded bands 76. The bores 78 of the beads 70 are not large enough to allow passage over the threaded keepers 30 and hinged keepers 40 when they are attached to the threaded bands 71 and unthreaded bands 76, respectively.

Figure 5:
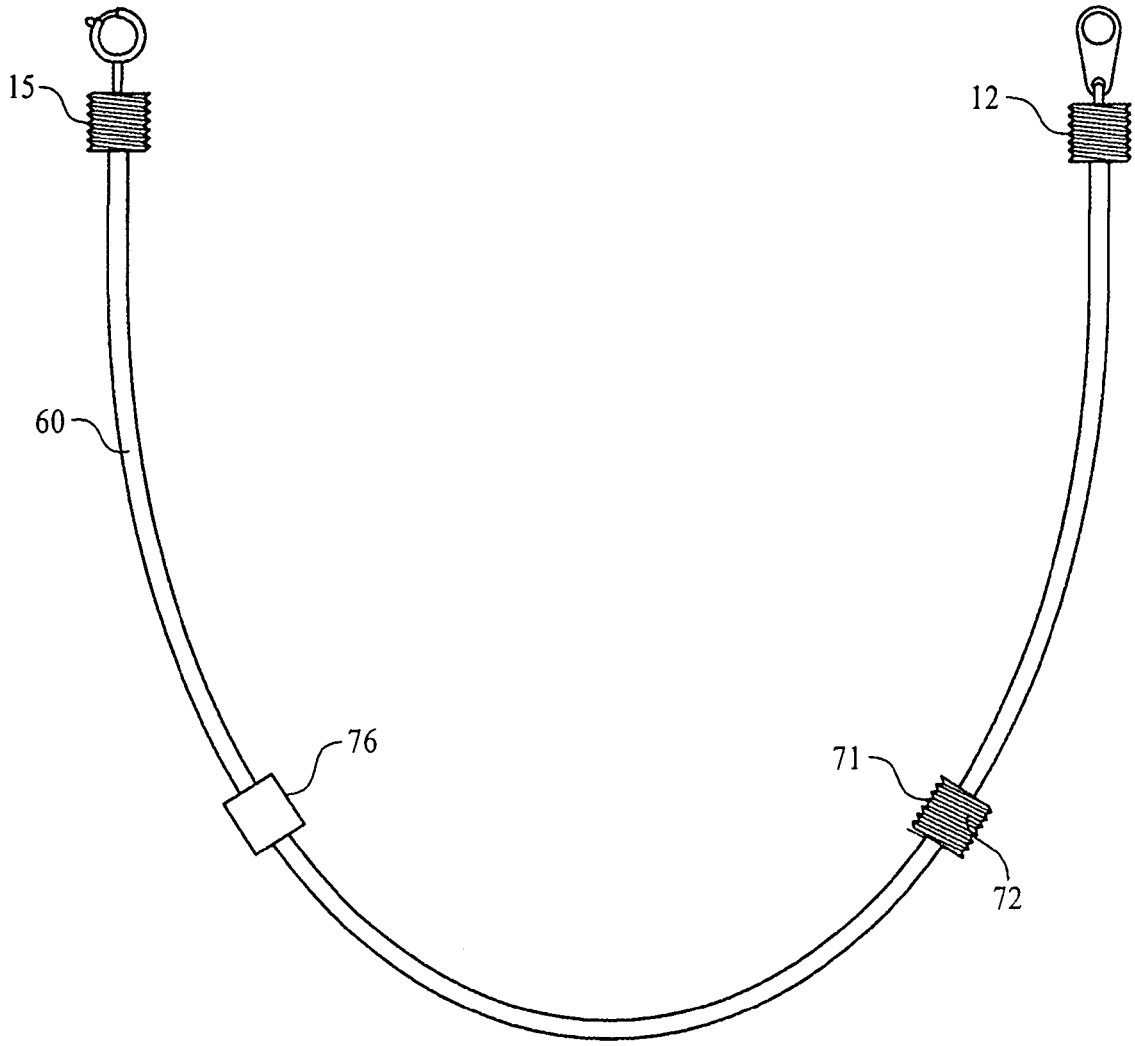
FIG. 5 shows the necklace without beads and without keepers.

FIG. 5 shows the necklace without beads and without keepers. Visible in FIG. 5 are the strand 60, loop connector 12, and hook connector 15. A threaded band 71 having threads 72 on the outer surface is shown fixed to the strand 60. The diameter and thread dimensions of the threaded band 70 are suitable for the threaded fixation of the threaded keeper 30 by its threads 34. The bore 32 of the threaded keeper is large enough to pass over the threaded keeper if the threaded keeper is manually rotated against the threaded band. A threaded keeper may be moved over a threaded band by rotating the threaded keeper against a threaded band thereby engaging the band and keeper threads and then disengaging the band and keeper threads. An unthreaded band 76 is shown fixed to the strand. The bore 53 of the hinged keeper is smaller than the diameter of the band. A hinged keeper 40 may be removably fixed to either an unthreaded or threaded band. A band, threaded or unthreaded, is fixed to the strand preferably by compression on the strand, by interaction with the links of a chain, or by adhesive, or any other suitable means of fixation of a band on a strand.

The diameter the threaded band is larger than the bore of the threaded and hinged keepers, thus preventing the movement of a threaded keeper past a threaded band unless the threaded keeper is rotated into engagement of the band and keeper threads, and preventing the movement of a closed hinged keeper past a threaded band. The diameter of an unthreaded band is large enough to prevent the movement of a closed hinged keeper past an unthreaded band but small enough to allow the movement of a threaded keeper past the unthreaded band.

Figure 6A:
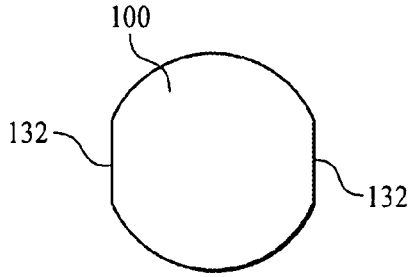
FIG. 6A is a front view of a spherical threaded keeper.

FIG. 6A is a front view of a spherical threaded keeper 100. The threaded keeper bore 132 is oriented at either end of the front view of the spherical threaded keeper 100.

Figure 6B:
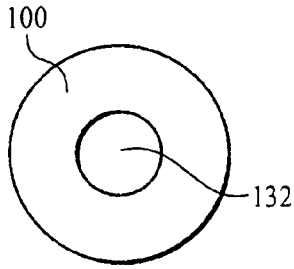
FIG. 6B is a side view of a spherical threaded keeper.

FIG. 6B is a side view of a spherical threaded keeper 100. The bore 132 is visible in the side of the spherical threaded keeper 100.

Figure 7A:
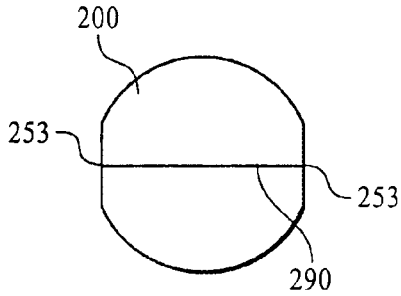
FIG. 7A is a front view of a spherical hinged keeper.

FIG. 7A is a front view of a spherical hinged keeper 200. The hinged keeper bore 253 is oriented at either end of the front view of the spherical threaded keeper 200. The intersection 290 between the upper and lower shells is shown in FIG. 7A.

Figure 7B:
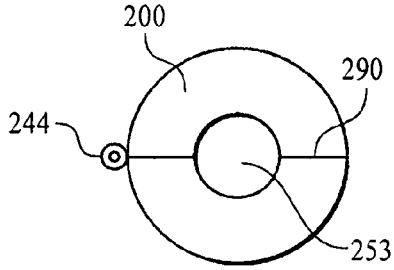
FIG. 7B is a side view of a spherical hinged keeper.

FIG. 7B is a side view of a spherical hinged keeper 200. The bore 253 is visible between the upper and lower shells and the intersection 290 between the upper and lower shells and the hinge 644 connecting the upper and lower shells are shown in FIG. 7B.

Figure 8A:
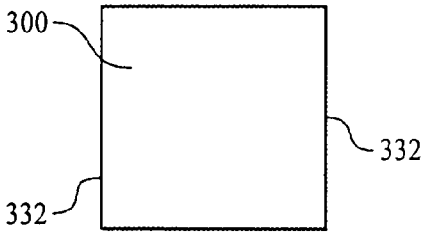
FIG. 8A is a front view of a cubical threaded keeper.

FIG. 8A is a front view of a cubical threaded keeper 300. The threaded keeper bore 332 is oriented at either end of the front view of the spherical threaded keeper 300.

Figure 8B:
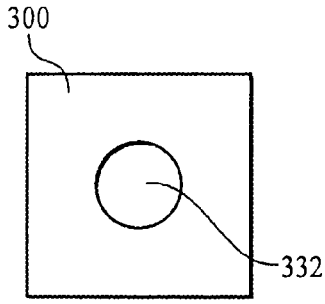
FIG. 8B is a side view of a cubical threaded keeper.

FIG. 8B is a side view of a cubical threaded keeper 300. The bore 332 is visible in the side of the cubical threaded keeper 300.

Figure 9A:
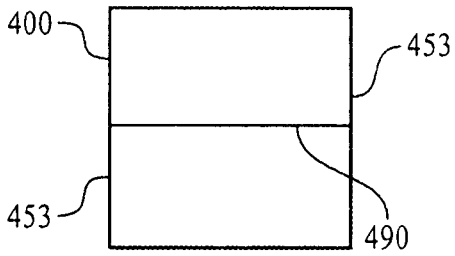
FIG. 9A is a front view of a cubical hinged keeper.

FIG. 9A is a front view of a cubical hinged keeper 400. The hinged keeper bore 453 is oriented at either end of the front view of the spherical threaded keeper 400. The intersection 490 between the upper and lower shells is shown in FIG. 9A.

Figure 9B:
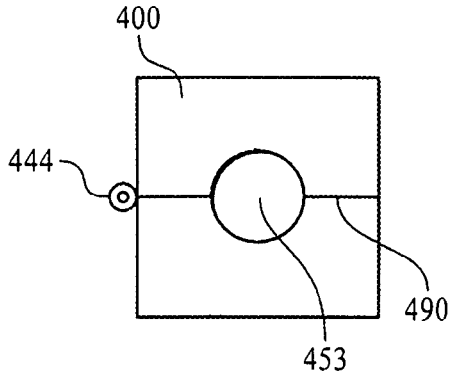
FIG. 9B is a side view of a cubical hinged keeper.

FIG. 9B is a side view of a cubical hinged keeper 400. The bore 453 is visible between the upper and lower shells and the intersection 490 between the upper and lower shells shells and the hinge 444 connecting the upper and lower shells are shown in FIG. 9B.

Figure 10A:
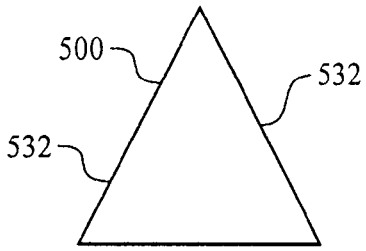
FIG. 10A is a front view of a pyramid-shaped threaded keeper.

FIG. 10A is a front view of a pyramid-shaped threaded keeper 500. The threaded keeper bore 532 is oriented at either end of the front view of the pyramid-shaped threaded keeper 500.

Figure 10B:
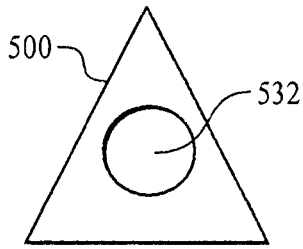
FIG. 10B is a side view of a pyramid-shaped threaded keeper.

FIG. 10B is a side view of a pyramid-shaped threaded keeper 500. The bore 532 is visible in the side of the pyramid-shaped threaded keeper 500.

Figure 11A:
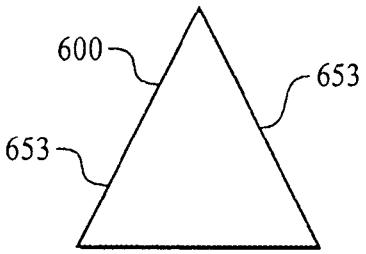
FIG. 11A is a front view of a pyramid-shaped hinged keeper.

FIG. 11A is a front view of a pyramid-shaped hinged keeper 600. The hinged keeper bore 653 is oriented at either end of the front view of the pyramid-shaped threaded keeper 600.

Figure 11B:
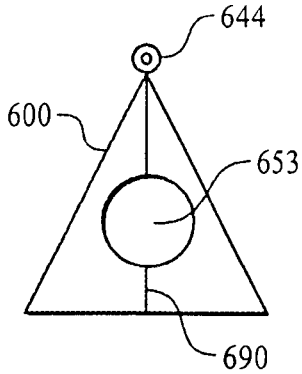
FIG. 11B is a side view of a pyramid-shaped hinged keeper.

FIG. 11B is a side view of a pyramid-shaped hinged keeper 600. The bore 653 is visible between the upper and lower shells and the intersection 690 between the upper and lower shells and the hinge 644 connecting the upper and lower shells are shown in FIG. 7B.

In use, the wearer strings beads and one or more threaded keepers on a strand having one or more threaded bands. The order of the beads and keepers is chosen in order to provide the desired distribution of beads on the necklace. The use of a hinged keeper provides additional flexibility for the wearer, as the hinged connector can be attached after the beads and the threaded keeper have been strung. The arrangement of beads and keepers may be altered by simply restringing the components on the strand.

Any suitable strong, flexible material may be used for the strand, or rigid material may be used in the form of a chain. A preferred material of construction is silver. Other suitable materials include bronze, steel, copper, plastic, and silk. Any suitable strong, hard material may be used for construction of the bands. A preferred material of construction is silver. Other suitable materials include stainless steel, copper, and plastic. Any suitable strong, hard material may be used for the keepers. A preferred material of construction is silver. Other suitable materials include bronze, steel, copper, and plastic.

It will be apparent to those skilled in the art that the examples and embodiments described herein are by way of illustration and not of limitation, and that other examples may be used without departing from the spirit and scope of the present invention, as set forth in the appended claims.

I claim:

1. A strand jewelry device comprising:

a strand having a first end and a second end, a connector assembly for reversibly coupling the first end and the second end of the strand, at least one band fixedly attached to the strand, the band presenting an outer circumference, at least one ornament, the ornament having a through opening of greater circumference than the outer circumference of the band, the greater circumference being sufficiently large to permit complete passage of the ornament over the band, and at least one keeper configured for reversible attachment over the band, the keeper being sufficiently large to prevent further passage of the ornament across the band when the keeper is attached to the band, wherein the keeper interacts with the band by abutment to restrict the movement of the ornament when the ornament resides on the strand.

2. The strand jewelry device of claim 1, wherein a bore of the keeper is threaded and the band is threaded on an external surface, the threaded bore of the keeper and the threaded surface of the band capable of interaction to reversibly fix the threaded keeper on the strand.

3. The strand jewelry device of claim 2 wherein the threaded keeper has any three-dimension geometric shape.

4. The strand jewelry device of claim 2 wherein the threaded keeper has a cylindrical, spherical, cubic, or pyramid shape.

5. The strand jewelry device of claim 1, wherein the keeper comprises two hollow sections hinged together, each section having two walls, each wall having a notch, each notch of depth approximating one half the diameter of the strand, the sections and the band capable of interaction by the hinged keeper engulfing the band to reversibly fix the hinged keeper on the strand.

6. The strand jewelry device of claim 5 wherein the sections are reversibly secured in a closed position by a latch attached to one section.

7. The strand jewelry device of claim 5 wherein the hinged keeper has any three-dimension geometric shape.

8. The strand jewelry device of claim 5 wherein the hinged keeper has a cylindrical, spherical, cubic or pyramid shape.

9. The strand jewelry device of claim 1 further comprising at least one threaded keeper and at least one hinged keeper.

10. The strand jewelry device of claim 9 wherein the threaded keeper and the hinged keeper further comprise decorative elements.

11. The strand jewelry device of claim 10 wherein the decorative element of the threaded keeper differs from the decorative element of the hinged keeper.

12. The strand jewelry device of claim 1, further comprising at least one ornament bore having a hole of sufficient size to pass over an element of the connector mechanism to permit residence of the bead on the strand, the size of the hole being insufficient to permit passage of the ornament over the keeper.

13. A process of reversibly restricting the movement of ornaments on a strand, wherein the strand has a connector assembly for detachably coupling the first end with the second end of the strand to configure the strand as a loop, the ornaments have bores and are strung on the strand by their bores, and a band having an external diameter less than the diameter of the ornament bores is fixed on the strand, comprising the steps of a stringing at least one ornament onto the strand; and, b a. attaching to the band a keeper having an external diameter greater than the diameter of the ornament bore.

14. The process of claim 13 wherein the band has an external thread and the keeper has a threaded bore, the keeper attached to the band by the steps comprising:

a. threading the keeper onto the strand, b. bringing the keeper and the band into contact, and c. rotating the keeper to engage the band and the keeper threads and attach the keeper to the band.

15. The process of claim 13 wherein the keeper has two hollow sections hinged together comprising the steps:

a. positioning the hinged keeper over the band, and b. closing the hinged keeper over the band to attach the keeper to the band.

16. A strand jewelry device that is selectively configurable by a wearer for positional ornament retention, comprising:

a strand having a first end, a second end, and at least one band of variant cross-section with respect to adjacent portions of the strand that are immediately adjacent to the band;

a connector assembly for detachably coupling the first end with the second end of the strand to configure the strand as a loop;

at least one keeper configured and arranged for selective placement around the band, the keeper having a bore of complementary dimensions with respect to the variant cross-section such that the keeper is retained in position at the band by abutment when installed on the band, at least one ornament, the band fixedly circumscribing the strand to provide the variant cross-section as a larger circumference with respect to the strand, the ornament defining a hole of sufficient dimension to pass over the larger circumference, the keeper having sufficient outer dimensions to prevent the ornament from moving across the keeper by abutment between the keeper and the band when the keeper the ornament are installed on the strand.

17. The strand jewelry device of claim 16, wherein the outer circumference of the band includes the band having a threaded outer surface.

18. The strand jewelry device of claim 17, wherein the bore of the keeper is internally threaded and the complimentary dimensions of the bore are taken with respect to abutment between the threaded outer surface and internal threads of the bore.

19. The strand jewelry device of claim 16, wherein the band has a smooth outer surface.

20. The strand jewelry device of claim 16, wherein the keeper has a bivalve construction for clamping around the band.

21. The strand jewelry device of claim 16, wherein the bivalve construction comprises a hinge pivotally connecting a first bivalve element with a second bivalve element, and a latch positioned for connecting the first bivalve element with the second bivalve element in a closed configuration that defines the bore.

22. The strand jewelry device of claim 16, wherein the bore comprises longitudinal notches running parallel with the strand.

23. The strand jewelry device of claim 16, wherein the strand presents a diameter and the longitudinal notches have a hemispherical construction approximating one half the diameter of the strand.

24. The strand jewelry device of claim 16, comprising a plurality of the keepers, the plurality of the keepers including at least one threaded keeper and at least one hinged keeper.

25. The strand jewelry device of claim 24, wherein the threaded keeper and the hinged keeper each present a decorative motif.

26. The strand jewelry device of claim 25, wherein the wherein the decorative element of the threaded keeper differs from the decorative element of the hinged keeper.

27. A strand jewelry device comprising:

a strand; presenting an elongate axis; an ornament adapted to receive the strand for passage of the strand through the ornament such that the ornament may pass over the elongate means for selectively configuring the strand as a loop;

means for adapting a circumference of the strand to permanently increase the circumference at a locus that permits passage of an ornament over the locus; and means for keeping ornament on a predetermined area of the strand by abutment with the means for adapting to prevent passage of the ornament over the locus.

28. The strand jewelry device of claim 27, further comprising a plurality of decorative ornaments positioned on the strand by the means for keeping.

* * * * *

UNITED STATES PATENT AND TRADEMARK OFFICE

CERTIFICATE OF CORRECTION

PATENT NO. : 7,007,507 B2 
DATED : March 7, 2006
INVENTOR(S) : Per Algot Enevoldsen It is certified that error appears in the above-identified patent and that said Letters Patent is hereby corrected as shown below:

Column 7,
Lines 58-62, replace "steps of a stringing at least one ornament onto the strand; and, b a. attaching to the band a keeper having an external diameter greater than the diameter of the ornament bore." with
-- steps of:
a. stringing at least one ornament onto the strand; and,
b. attaching to the band a keeper having an external diameter greater than the diameter of the ornament bore. --.

Column 9,
Line 8, delete ";" after "strand".
Line 11, insert -- axis; -- after "elongate".
Line 11, insert a paragraph return after "elongate axis;".

Signed and Sealed this

Thirtieth Day of May, 2006

JON W. DUDAS
*Director of the United States Patent and Trademark Office*